US005608966A

United States Patent [19]

Donner et al.

[11] Patent Number: 5,608,966

[45] Date of Patent: Mar. 11, 1997

[54] PROCESS FOR MANUFACTURE OF SPRING CONTACT ELEMENTS AND ASSEMBLY THEREOF

[75] Inventors: Edward O. Donner, Poughkeepsie, N.Y.; Michael L. Zumbrunnen, Rochester, Minn.

[73] Assignee: International Business Machines Corporation, Armonk, N.Y.

[21] Appl. No.: 356,025

[22] Filed: Dec. 14, 1994

[51] Int. Cl.[6] ..... H01R 43/00

[52] U.S. Cl. ..... 29/884; 29/882; 439/66

[58] Field of Search ..... 29/882, 884, 874; 439/66, 67; 174/52.4

[56] References Cited

U.S. PATENT DOCUMENTS

| | | | |
|---|---|---|---|
| 3,766,646 | 10/1973 | Froebe et al. | 29/884 X |
| 3,921,285 | 11/1975 | Krall | 29/626 |
| 4,190,951 | 3/1980 | Armstrong | 29/882 |
| 4,706,382 | 11/1987 | Suppinger et al. | 29/884 X |
| 4,764,848 | 8/1988 | Simpson | 361/408 |
| 5,061,192 | 10/1991 | Chapin et al. | 439/66 |
| 5,248,262 | 9/1993 | Busacco et al. | 439/66 |

OTHER PUBLICATIONS

IBM Technical Disclosure Bulletin, vol. 28, No. 3, Aug. 1985, entitled "High Density Pinless Module Array Connector" by R. Darrow et al, pp. 1079–1081.

*Primary Examiner*—Peter Vo
*Assistant Examiner*—Khan Nguyen
*Attorney, Agent, or Firm*—Bernard M. Goldman

[57] ABSTRACT

A method of manufacturing thousands of contacts between electronic packages and their next package level by use of small wires retained within a interposer structure or soldered directly into a printed circuit board or onto the module. Each wire can be either a signal or power connection. The wires may have multiple cross-sectional shapes compared to one another and are preformed before assemble into an array retainer. The retainers contain the multiplicity of wires and are used for additional process steps and as the final housing of the connector assembly.

19 Claims, 11 Drawing Sheets

PROCESS FOR MANUFACTURE OF SPRING CONTACT ELEMENTS AND ASSEMBLY THEREOF

BACKGROUND OF THE INVENTION

This invention relates to a device for interconnecting two electronic components with large number of individual connections that can be easily disconnected and reconnected, can accommodate surface irregularities and thermal expansion/contraction between the components. A large number implies thousands.

As the circuit density increases on the chip, the number of input and output signals to these chips also increases. These i/o are compressed into a small area to assembly the chip density and are used for the chip to communicate to other nearby chips or to other components in the system. The chips can be attached to a ceramic device as shown in U.S. Pat. No. 3,921,285, issued to Krall and assigned to the present assignee. This patent shows a rigid ceramic chip carrier attached to silicon integrated chips. This ceramic carrier is usually attached to a printed circuit board which integrates a large number of these chips contained on ceramic chip carriers. On systems with multiple processors, usually multiple ceramic carriers are used to allow for performance growth in the customers office by adding additional processors. High reliability is a key and essential criteria for a separable and reconnectable connector for these chip carriers and as a result must be tolerant of dust and mini fibers.

Also when connecting two surfaces, such as the ceramic material and the glass-epoxy. printed circuit board, a significant amount of compliance is required for the glass-epoxy board and must be accommodated by the connector. This is due to the flatness and irregularities inherent in the surfaces of the board and electronic module. The planarity and rigidity of the ceramic is relatively good and as pressure is applied to the edge of the ceramic component to make connection for a plurality of connectors, the glass-epoxy printed circuit board has a tendency to bow as the area array increases. This bowing must be accommodated by the connector. Very large ceramic modules may bow as well if pressures are applied to the perimeter only.

An article titled "High Density Pinless Module Array Connector" by R. Darrow et al, IBM Technical Disclosure Bulletin, Vol. 28, No. 3, page 1079, (August 1985) discloses a connector assembly with wires bent to form a C spring at one end with the other end inserted into the plated through hole of a printed circuit board and soldered. The C spring rests on a plastic housing that supports the force applied by the ceramic module. The density of this connector array is limited by the density of the plated through holes in the printed circuit board and the plastic housing to support the force applied to the C spring by the ceramic module. Density will also be impacted by the C spring shape infringing with the adjacent C spring.

U.S. Pat. No. 4,764,848 issued to Simpson discloses a connector of bent wires which are soldered to both the ceramic chip carrier and the printed circuit board. Each wire has a root at one end and a tip at the other end. The root of each bent wire is attached to the integrated circuit package to form a fixed electrical and mechanical connection. The tip of the bent wire is soldered to a pad on the surface of the printed circuit board. This arrangement provides for strain relief of the connection and mechanically fixes the ceramic device to the board. This disclosure does not provide for an easily removable connector,especially in the customers office.

U.S. Pat. No. 5,248,262 issued to Busacco, et al and U.S. Pat. No. 5,061,192 issued to Chapin, et al discloses a connector assembly with small flat beams attached to a flexible film and contained inside a housing. The small flat beams are copper etched on a polyamide strip, are placed in and extend through the housing, and make contact with pads on circuit members on opposite sides of the connector assembly. This strip of connecting elements is made from several layers of etched or bonded material including a conducting element that contacts the pads, a polyamide backing material, a copper ground plane material and, in the case of U.S. Pat. No. 5,248,262, a stainless steel spring material bonded to but electrically isolated from the copper ground plane. A plurality of the connector elements are contained, and spaced evenly, on the polyamide strip along with the stainless steel spring. The housing contains long slots for the strips to protrude through the surface to make contact with pads on circuit members. The polyamide film retains the contact elements in a single strip and multiple strips make up a connector assembly. Within a single strip, compliance is limited from contact to contact because of the rigidity of the film in that direction. Each contact element has its reacting stresses and strains within its joints set by the amount of its compression and the amount of compression of its adjacent neighbors. As a result, some of the stresses and strains are parallel with the strip and cause shearing to the assembly. To limit the adverse affect of the shearing forces, two precautions must be taken. One is to limited the surface flatness irregularity of the printed circuit board to be within the design limits of the connector assembly. Second, each contact within a strip should be compressed simultaneously, i.e., upon assembly, guides should be used to uniformly force the electronic module upon the array with minimum degree of tilt.

Inherent with the design of having multiple contacts contained within a single strip is that a constant spacing is present between adjacent strips. This limits the degree of optimization of the connector assembly to the application. The tolerances associated with fabricating a single connector strip and bonding to a spring strip may limit the overall length of the strip; and hence, the number of contacts of the connector assembly. The use of connector strips limits the ability to adjust at each contact point the forces applied to the electronic components. These forces caused by the springs will bow the mating surfaces, and depending on the application, may limit the number of contacts allowable. Thus, for high performance applications with high input and output requirements, it is desirable to customize the spring characteristics based on spacial position within the connector array so that module deflections are minimized and number of contacts are maximized.

It is believed that a method of making and assemble a sprint contact element as defined herein which is capable of being used in a separable connector that provides superior electrical characteristics, high reliability, low cost, ease of manufacture, the flexibility to personalize to each application and other advantageous key features below, as contained in this disclosure, advances the state or the art.

It would be highly desirable to have a simple, inexpensive, contact element made from a common source which is extremely reliable with no failures due to delimitations and failed bonds resulting from thermal cycling and aging.

It would also be desirable to have a device to retain these contact elements such that air spacing is provided to adjacent elements for performance and cooling.

It is highly desirable this retainer provide precision alignment via holes and the material can be adjusted for thermal expansion, also with this arrangement each element can individually react to the contact surface.

Also it would be advantageous to personalize the characteristics of each individual contact element and its spacial relationship to the neighboring contact element.

It is also highly desirable that the retainer and contact element assembly accommodate the thermal mismatches between the mating components.

Also it would be essential that the following criteria be met in the disclosure to enhance its flexibility of application:

To improve the packaging density, both sides of the printed circuit board should be utilized which reduces the average wire length and improves the performance of the system.

To provide the maximum density of connections, an area array of these contacts is necessary. Any other configuration would not provide sufficient connections in a given area.

The connector assembly must also exhibit the characteristic of low electrical noise since the application will connect very high speed integrated circuits.

The connector assembly must support large amounts of current in this small area. This leads to a requirement for cooling the connector as power demands are significant.

SUMMARY OF THE INVENTION

It is therefore a primary object of this invention to provide a method of making a spring contact element through an automated fabrication procedure consisting of cutting, stamping, and forming the wire into individual springs. For prototype hardware, the process steps can be done manually. An array of spring elements are retained in a housing and each spring has its ends gold electroplated for low joint electrical contact resistance. Each Spring contact element (SCE) can have unique bulk material properties and mechanical properties by its degree of cross-sectional shaping and angular formation. An improved electronic connector is achieved from the array of one or multiple part number spring contact elements.

It is also an object of this invention to assemble at reasonable cost and throughput a high density and high current carrying connector that can be used to join in a separable manner an electronic module to a printed circuit board.

BRIEF DESCRIPTION OF THE DRAWINGS

FIG. 2A is a top view, FIG. 2B is a side view, and FIG. 2C is an end view.

FIG. 6A and FIG. 6B shows the resulting wire shape after being formed, in which FIG. 6A is a top view and FIG. 6B is a side view.

DESCRIPTION OF THE INVENTION

The present disclosure relates to the design and the manufacturing process of an enhanced electronic module connector having high density, high current carrying, low cost and high performance. An improved conductor array, according to a preferred embodiment, comprises of optimized spring contact elements, each uniquely tailored to the requirements set by the spacial locations of each element. An automated fabrication procedure dices, stamps, forms, and installs the spring elements into its final retainer. The ends of the spring contact elements are gold electroplated for low joint electrical contact resistance.

Figure 1:
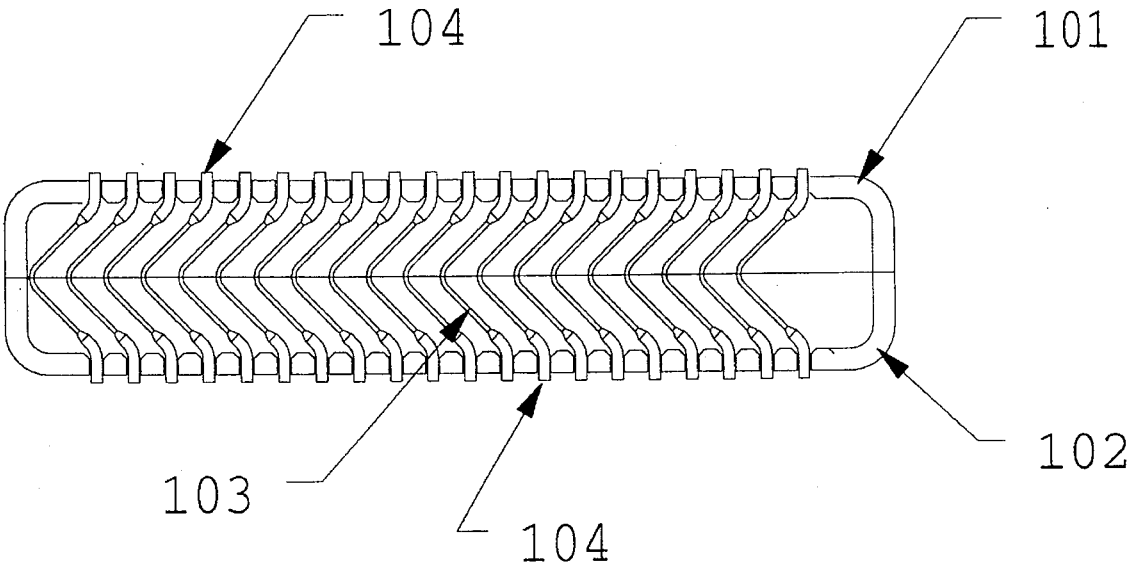
FIG. 1 shows a completed connector assembly of one embodiment.

FIG. 1 is an illustration of a completed improved electronic module connector as manufactured by the processes described in the present invention. An upper retainer housing 101 and a lower retainer housing 102 are sized to the application requirements and hold a matrix of spring contact elements 103. The ends 104 of the spring contact elements protrude slightly from the retainer, and, when assembled to the electronic module(s) and/or printed circuit boards, will be compressed together. The compression forces will bend the spring contact elements and will be reacted by forces dictated and controlled by the design of spring contact elements.

In these figures, only a portion of the SCE array is visible, and one can imagine the array extending to many rows and columns as required by the application. In general, the connector can house N rows ×M columns of SCEs with N and M not necessarily equal. To achieve the high density objective of this invention, it is desirable to space each SCE as close as possible to one another. The degree to which the space between the spring contact elements can be reduced is dependent on the ability to manufacture the connector as well as the ability of the motherboard to support the sheer number of interconnections in a small area. A typical centerline spacing satisfying these constraints is 1 to 1.5 mm.

Figure 2A:
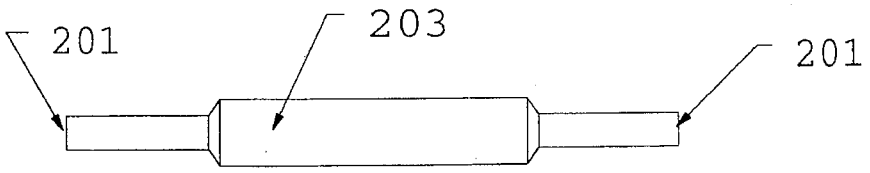
FIGS. 2A–C contains three view of the spring contact element.
Figure 2B:
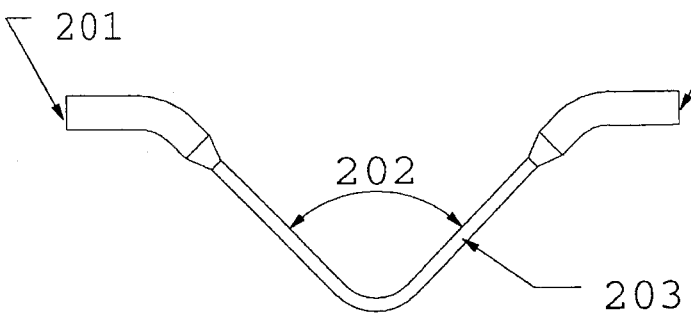
Figure 2C:
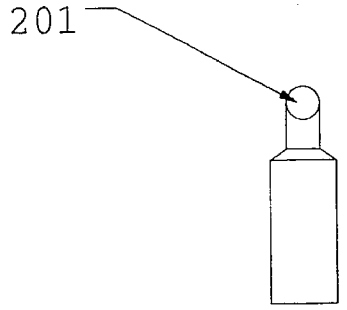

The elements are manufactured from a round cross-sectional wire and formed into the shape shown in FIGS. 2A, 2B, and 2C. For illustrative purposes, beryllium copper C17200 half hardened, can be the bulk wire material. This material is readily available in wire form, widely used as a spring material, has very good workability and soldering properties, and has reasonable electrical conductivity (22% pure copper). Any other material having these attributes is suitable for this invention. The bulk material is prehardened by heat treating in an oxygen-free atmosphere. For harsh environment applications, the bulk material can be electroplated with nickel and palladium for resistance to corrosion. The spring contact element has a rectangular cross-section 203 at a prescribed portion centered about the included angle 202. The ends 201 are aligned co-axially with each other.

Figure 3C:
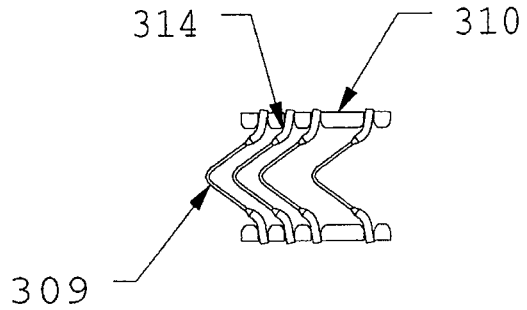
FIG. 3C is exploded view of the cross-section shown in FIG. 3A with the SCE compressed.
Figure 3B:
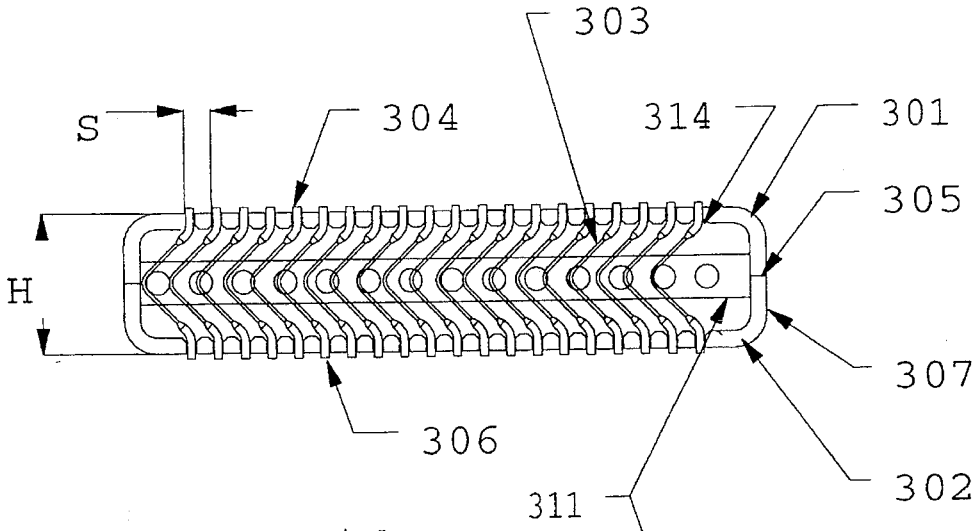
FIG. 3B is a cross-sectional view of the preferred embodiment in which the connector assembly is not attached to either the ceramic component or the printed circuit board.
Figure 3A:
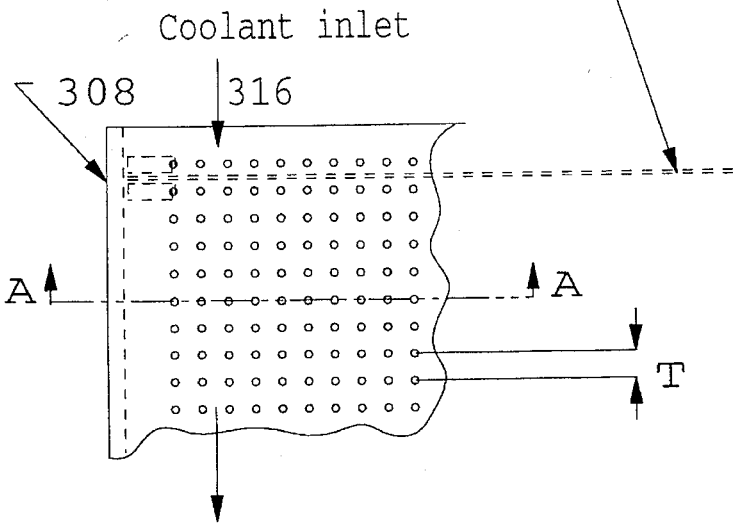
FIG. 3A is a top view of the connector assembly.

FIG. 3B illustrates the preferred embodiment cross-section with SCE 303 being held in place with retainer halves 301 and 302. The mating surface between the two halves is indicated by 305. A perforated dielectric separator 311 is located between the rows of SCE 303 to keep them from shorting to each other. The retainer halves 301 and 302 are fabricated from a die-electrical material, such as polyphenalyne sulfide, to provide electrical isolation between every SCE 303. If required, air can be forced through the retainer as shown in FIG. 3A. This allows for cooling in high current applications. The coolant 316, air for example, is pumped through the interior of the retainer halves and flows above, below, and through the perforated separators 311. The heated coolant exhausts at the other end of the retainer at 317. The side walls 307 and 308 attached the two retainer halves together and prohibit the coolant from escaping prematurely. The coolant entrance and exit sides of the retainer halves may have discrete mating locations for extra large connector applications. The grid distances between the SCE, S, may vary but is typically between 1 and 1.5 mm as previously stated. The outer edges of the retainer are indicated by 307 and 308. The ends of the SCE 304 protrude through the retainer and make contact with gold plated pads on the surface of the attaching component as does the other end 306 to its respective pad on the printed circuit board. As pressure is applied by these components from opposite sides, the SCEs 303 are compressed into the retainer halves 301 and 302. The holes 314 are countersunk on the inside of the retainer halves to keep the SCEs 303 from binding on the inside of the retainers. The overall height of the connector assembly, H, is typically between 4.5 and 7.5 mm. FIG. 3B shows the SCE 303 in the uncompressed position. FIG. 3C is a portion of FIG. 3B showing the SCE in an exaggerated compressed position. Sufficient clearance is provided by the countersunk holes 314 as depicted. Not shown are the upper and lower electronic modules which applies the compressing force upon the SCEs 303. FIG. 3C also illustrates the embodiment in which the spacing 310 between SCEs 303 need not be uniform across the array. This is also true for the direction in to and out of the plane illustrated in the figure.

Figure 4:
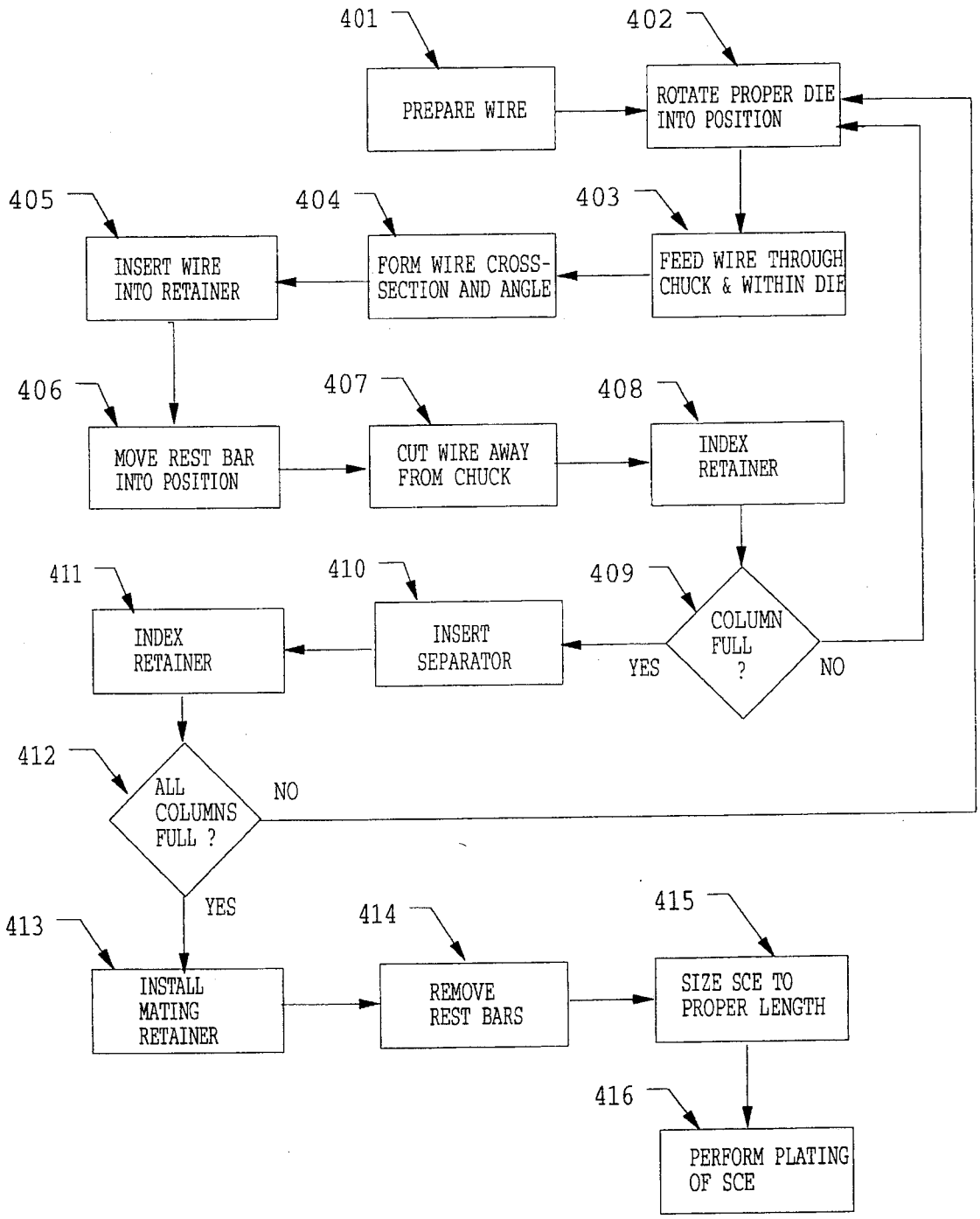
FIG. 4 shows the flow of the process to form and assemble the connector.

A process flow diagram is shown in FIG. 4 and described with the aid of subsequent figures. A spool of wire is first prepared by step 401 for the process by hardening. For illustrative purposes, beryllium copper C17200 half hardened, can be the bulk wire material. This material is readily available in wire form, widely used as a spring material, has very good workability and soldering properties, and has reasonable electrical conductivity (22% pure copper). Any other material having these attributes is suitable for this invention. The bulk material is prehardened by heat treating in an oxygen-free atmosphere. Additional preparation may be desired depending on the application. For harsh environment applications, the bulk material can be electroplated with nickel and palladium for resistance to corrosion.

Next in FIG. 4, a chuck containing a predetermined die is rotated by step 402 into position. If an overlong deformed wire to be installed is not the same as the previously installed wire, then the preceding chuck assembly is automated rotated away from the retainer and the correct chuck assembly having the correct deformed wire is rotated into place. Multiple dies may be needed for a complete connector assembly although only one die is used at one time.

Figure 5:
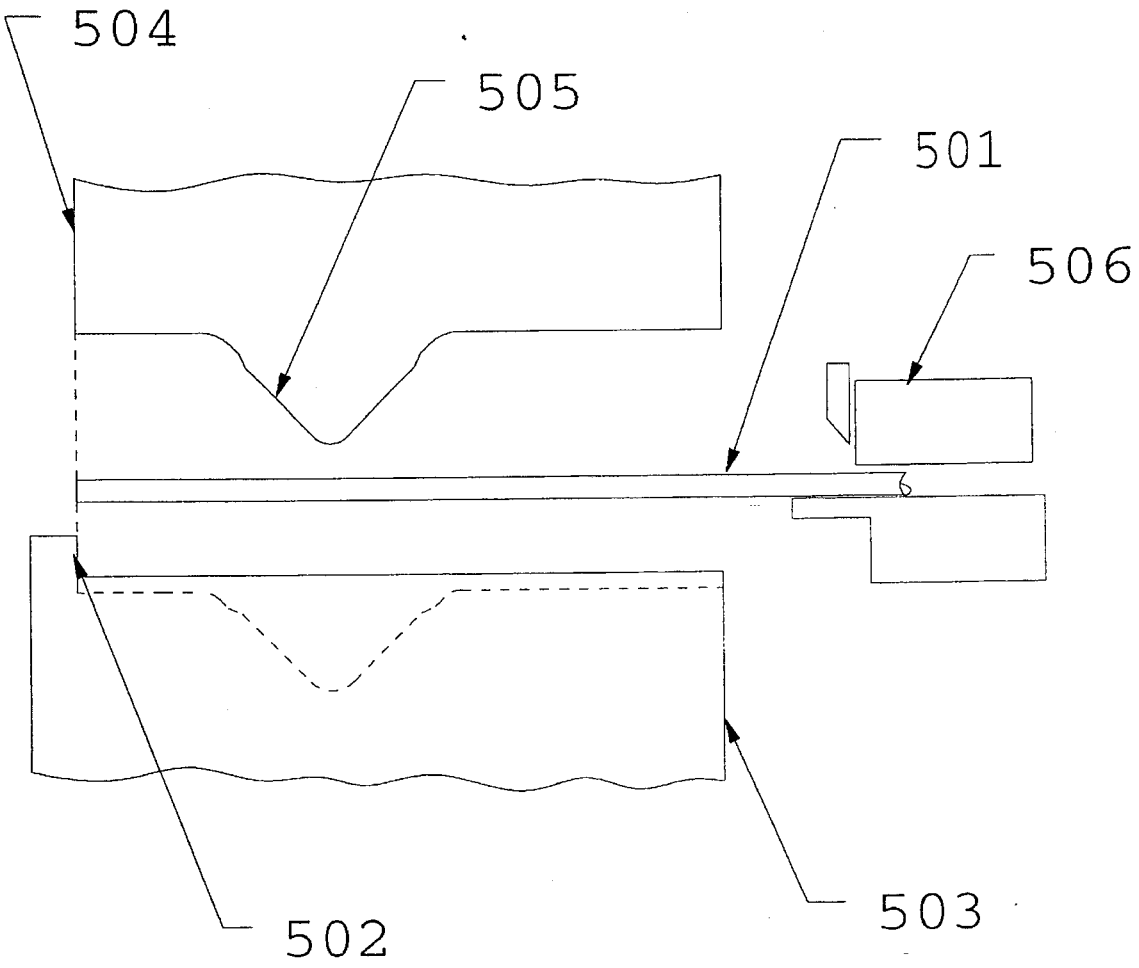
FIG. 5 is an illustration of the forming process and apparatus.

In FIG. 4, the wire is fed by step 403 from a spool, also mounted with the chuck, through the chuck and die. The wire is automatically transferred through a chuck 506 until a small amount travels past the leading edge cutter 502 located in the lower die 503. The wire is now formed by step 404 to its prescribed shaped as shown by FIG. 5. The lower die has machined into its top surface the outline of the bottom surface of the spring contact element. The contour of the top surface of the spring contact element is machined into the upper die 504. Forced together, the two die plastically bend the wire and deform the round cross-section. The degree of cross-section deformation is controlled by the oversized centered portion 505 of the upper die. Multiple die may be used within any connector assembly with each die having different 504 and 505 shape attributes.

Figure 6A:
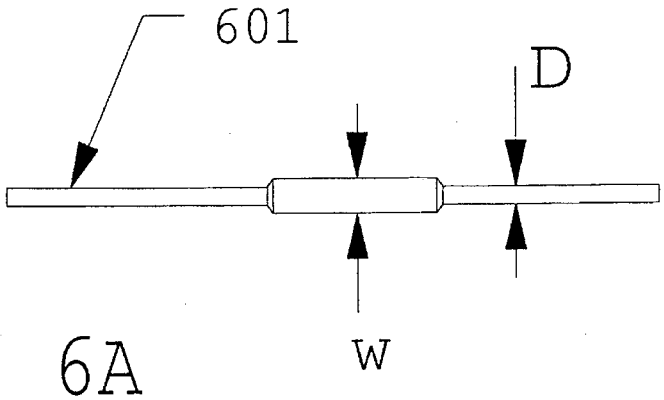
Figure 6B:
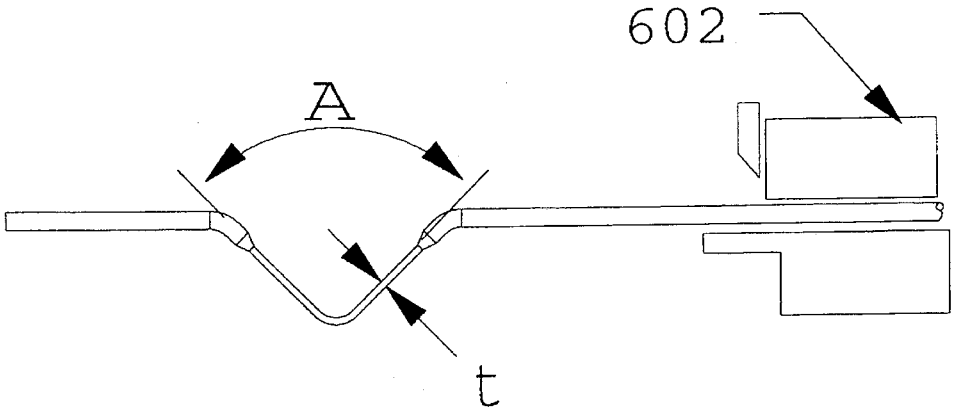

The resulting deformed wire is described in FIGS. 6A and 6B. FIGS. 6A and 6B shows the wire after it has been formed. The chuck 602 continues to hold the deformed wire 601 for additional process steps. At this stage, the wire is longer than that shown in FIG. 2. The stamping process forms an included angle, A, into the wire and deforms the round cross-section of diameter, D, to a rectangular cross-section of thickness, t, and width, w. The mechanical dimensions, A, t, and w are optimized to meet the application requirements by customizing the upper and lower dies of FIG. 5. The application requirements across the entire array may be such that a single set of A, t, and w cannot satisfy the requirement. Hence, multiple sets of A, t, and w may be required and this is achieved by having multiple dies. It is preferable for high current carrying applications to use a large diameter wire, for example, 0.38 mm.

Figure 7A:
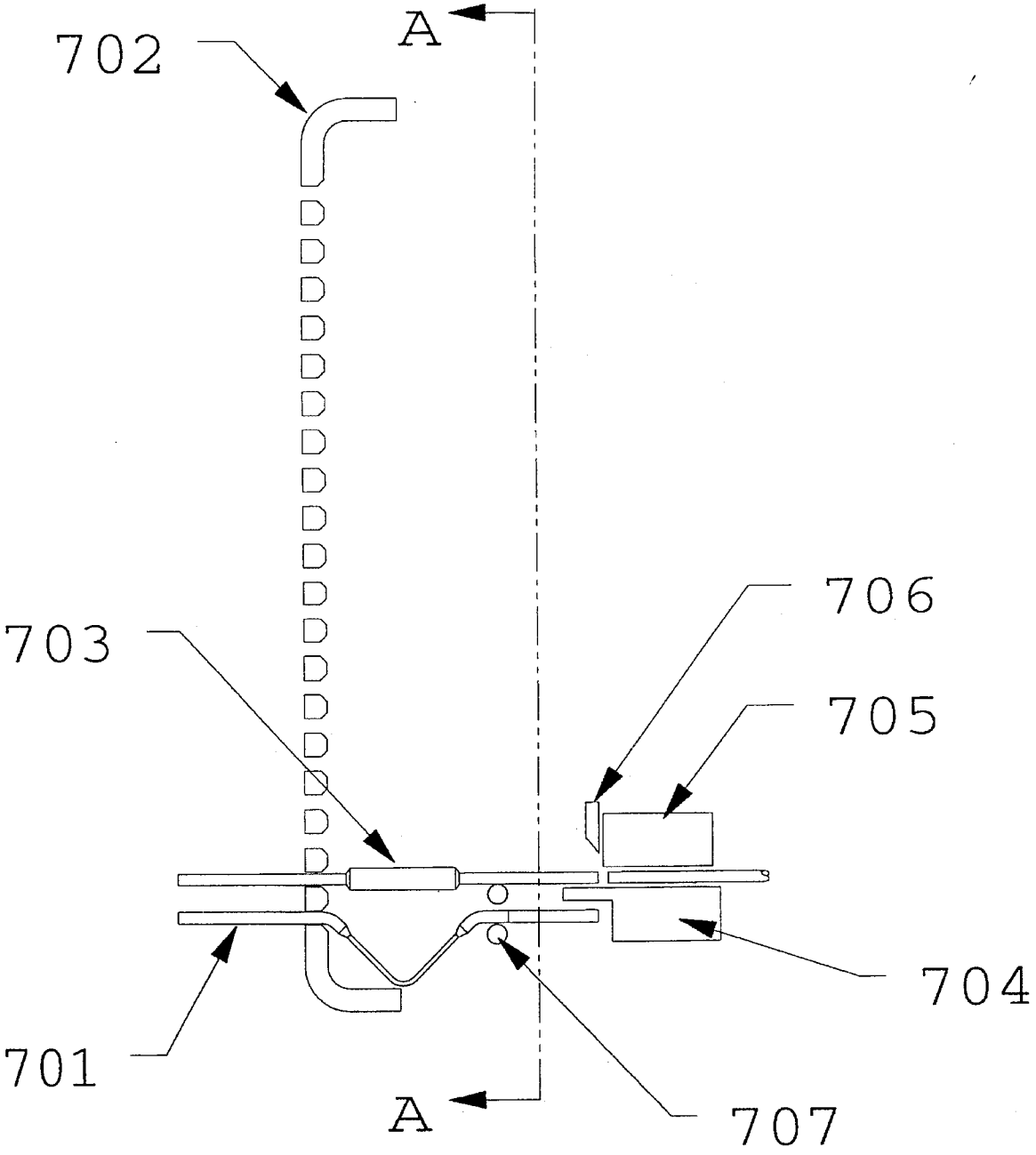
FIG. 7A shows the holding jig for the SCE and the cutting process step and FIG. 7B shows loading one half of the retainer.
Figure 7B:
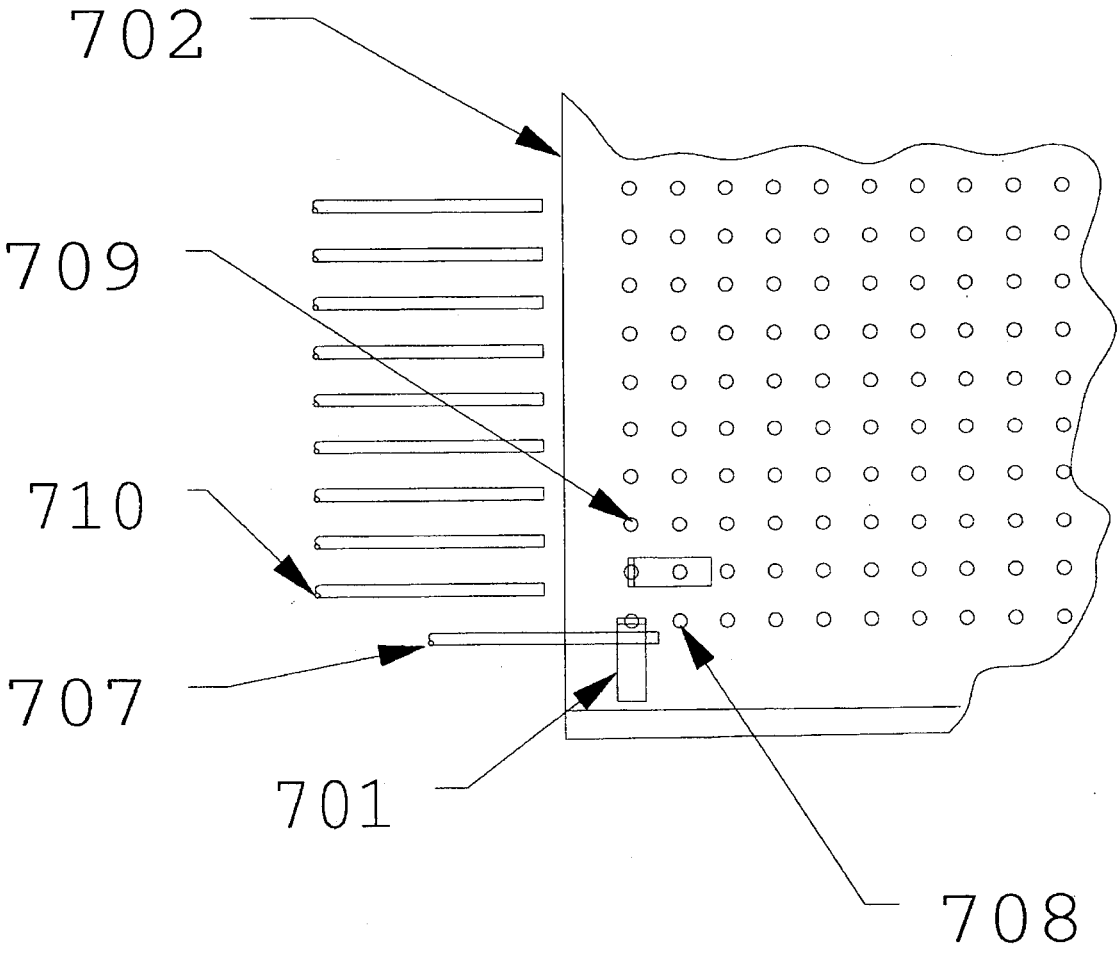
Figure 7C:
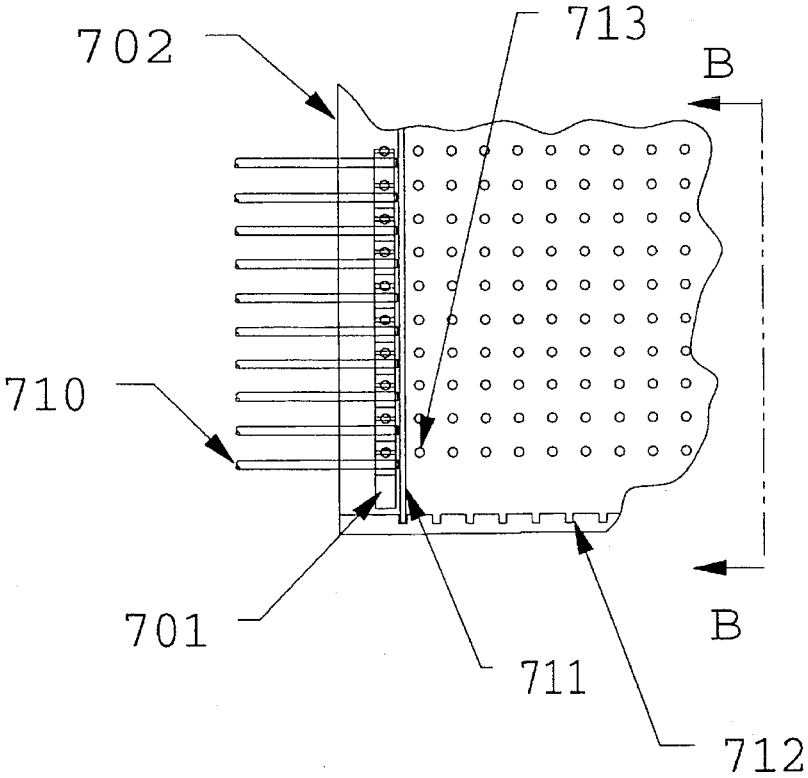
FIG. 7C shows the jig holding a partial set of SCE with a perforated separator in place.

In FIG. 4, the overlong formed wires are then inserted by step 405 into the retainer as described by FIG. 7A, FIG. 7B and FIG. 7C. A retainer half 702 is fixtured vertically and is prepared to receive overlong deformed wires by first aligning the centerline of its lower left hole to the centerline of the overlong deformed wire that is retained by the chuck 704 and 705. Each of the holes are chamfered on the inside of the retainer to lessen the centerline tolerance control and facilitate easier wire insertion. Prior to the installation of the wire into the retainer, the wire is rotated 90 degrees counterclockwise from its final position. The overlong wire 703 is in such position. After the wire is inserted completely into its retainer hole, it is rotated 90 degrees clockwise. Next, rest bar 707 is indexed by step 406 under the wire but not beyond the mid point to hole 708. A cutter 706 cuts by step 407 the wire from the spool and causes the overlong deformed wire 701 to be completely restrained by the retainer 702 and the rest bar 707. At this point, the next deformed wire can be fabricated by having a finite length of wire fed through the chuck assembly and repeating the stamping process as detailed by FIG. 5.

Referring to FIG. 7B, the retainer 702 is indexed in step 408 in FIG. 4, downward by one hole-to-hole spacing such the centerline of hole 709 is inline with the centerline of wire 703. As before (but now with the recently formed overlong wire), the wire is rotated counterclockwise as shown in FIG. 7A and 7B and is denoted by wire 703, is inserted into the receiving hole, the next rest bar 710 moves into place, the wire rotates clockwise (thereby placing its bent portion within the bent portion of wire 701), and the cutter 706 cuts the wire away from the spool. This procedure is repeated until the entire column of holes of the retainer, requiring a wire, is filled by step 409 with overlong formed wires. It is not a requirement for each hole to have a wire.

Figure 7D:
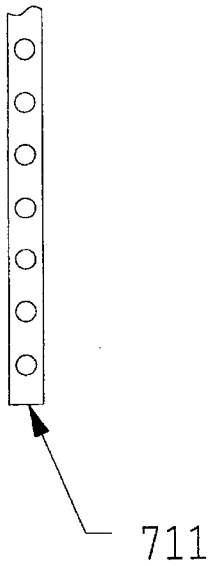
FIG. 7D shows a separator.

FIG. 7C shows the insertion by step 410 of a perforated separator between columns. After an entire column is completed, a perforated separator 711 is inserted by step 410 into the grooves 712 located in the retainer 702 as shown in FIG. 7C. The perforations can be seen by viewing the subassembly at section B—B. This section is shown in FIG. 7D with only the perforated separator visible. The separator 711 is made from a di-electrical material and is used to prohibit the SCEs from contacting one another. The perforations within the separator are only used for high current carrying applications and are not typically required. The retainer is then indexed by step 411 and each column is populated and each column is separated by perforated separators until all columns have been completed. One by one, the rest bars 710 travel horizontally across the connector housing, and eventually, the entire array is filled by step 412. At this time, the mating retainer to 702 is partially inserted by step 413 over the overlong SCE array so that each SCE is held within its respective hole in the mating retainer. Then, the entire set of rest bars 710 are removed by step 414 and are now available for the next connector assembly. Once the rest bars are removed, the mating retainer half is completely moved to contact 702, and mated by an adhesive such as epoxy or adhesive tape.

Figure 8:
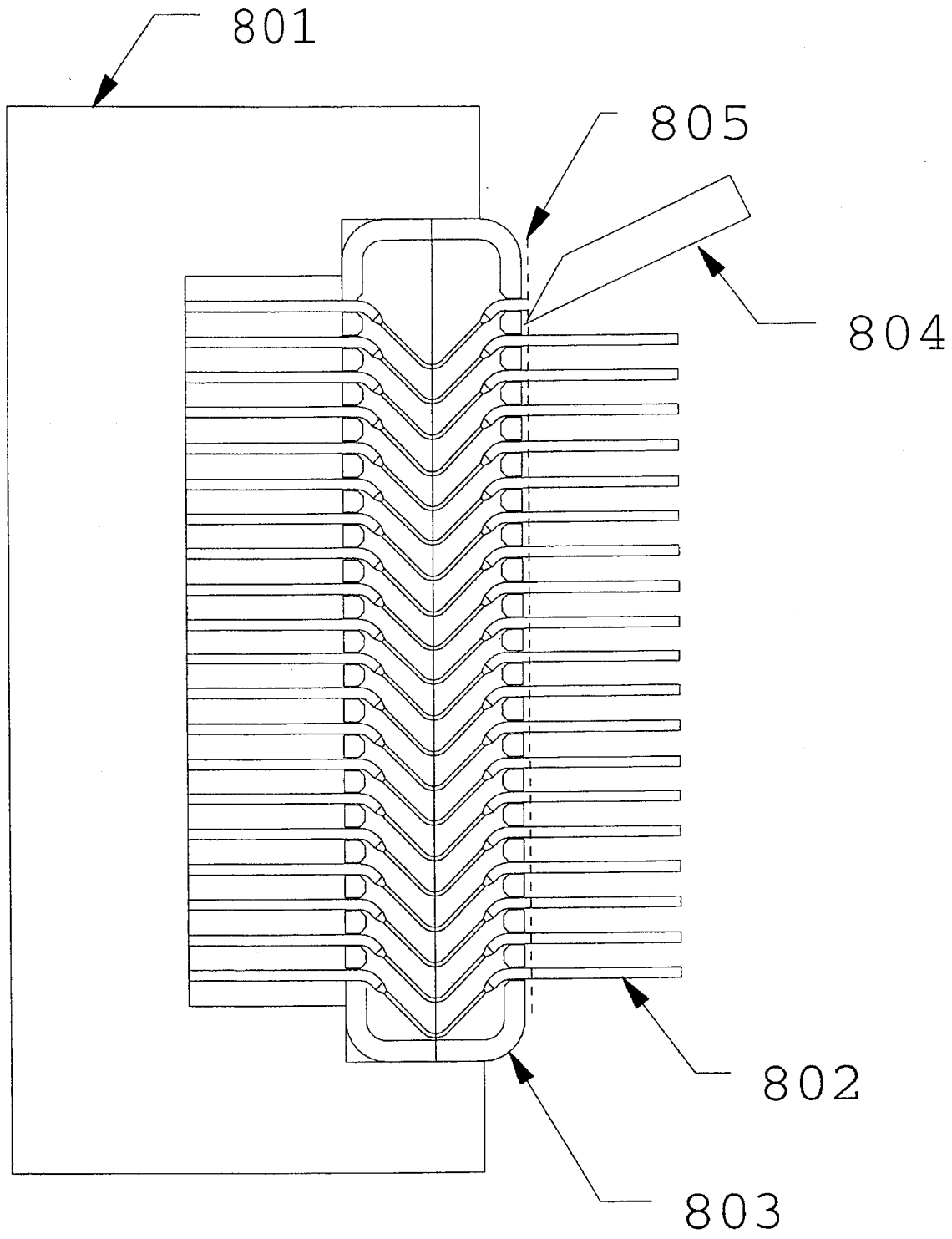
FIG. 8 illustrates a process step in which the array of spring contact elements are sized to the proper length.

Next FIG. 8 depicts the process step that sizes by step 415 the overlong deformed wires to the desired length. A length gage 801 is used to center the overlong deformed wires 802 between the retainers 803. A cutter 804 travels across the array shown by the dotted line 805. The cutter can cut each SCE individually as it passes across the array, or multiple SCE can be cut at a time depending on cutter size and SCE spacing. Another gage and cutting step is used to size the other end of the wire. Before proceeding to the finishing step, the SCE ends are deburred and the sub-assembly is cleaned by conventional means.

Figure 9:
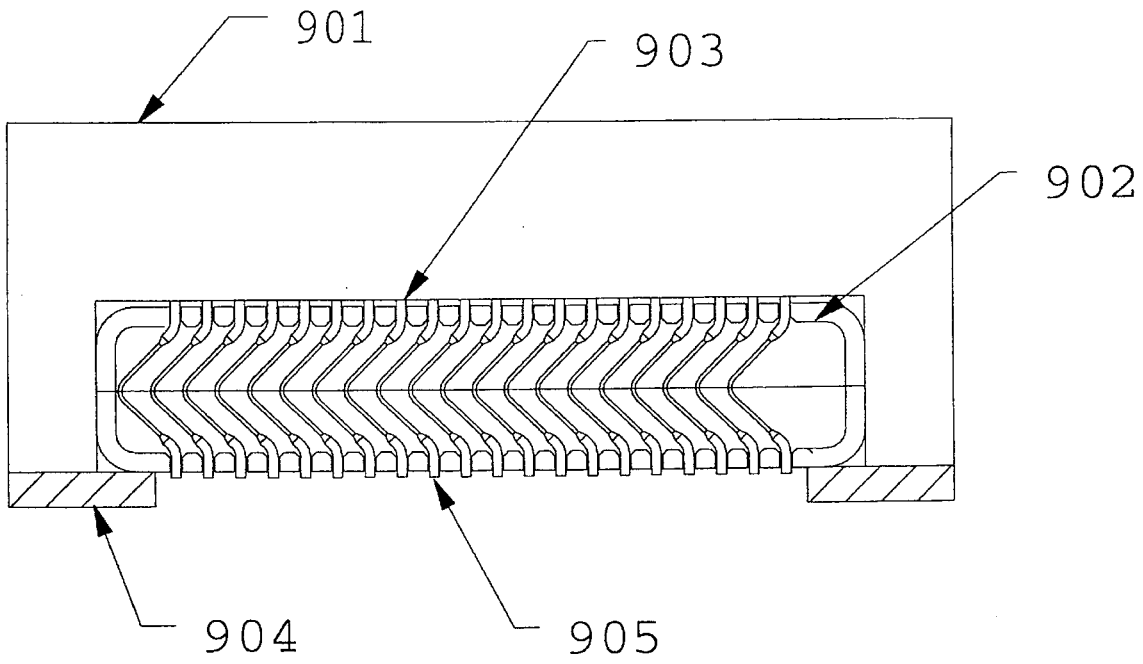
FIG. 9 depicts the fixturing used to plate one end of the spring contact elements' ends.

After the wires have been cut to size, the SCE's are electroplated by step 416 with nickel and palladium for resistance to corrosion, and the SCE ends are enhanced for electrical contacts by gold plating as illustrated by FIG. 9.

FIG. 9 shows a fixture to house the connector assembly 902 for gold electroplating. The conducting fixture 901 makes electrical contact with each wire at their ends 903. The cover plate 904 locks the assembly against the fixture and assures good electrical contact. The ends 905 are now ready for plating. The ends are first plated with low stress Ni, using a conventual nickel sulfamate process. Next gold is plated over the nickel with a minimum thickness of typically 0.75 micrometers. Other plating material could be used, such as Pd—Ni, for lower cost applications; However, for high performance applications, gold is preferable, or alternatively, palladium dendrites can be formed by conventional processes.

FIGS. 5 through 9 illustrate the above process steps in somewhat more detail. In the following descriptions each Fig. is discussed individually without regard to process flow and, additionally, expands on some process steps.

FIG. 5 depicts in an expanded view of the die to form the pre-formed hardened wire 501 to the desired shape. The wire is automatically transferred through a chuck 506 until a small amount travels past the leading edge cutter 502 located in the lower die 503. The lower die has machined into its top surface the outline of the bottom surface of the spring contact element. The contour of the top surface of the spring contact element is machined into the upper die 504. Forced together, the two die plastically bend the wire and deform the round cross-section. The degree of cross-section deformation is controlled by the oversized centered portion 505 of the upper die. Multiple die may be used within any connector assembly with each die having different 504 and 505 shape attributes.

FIGS. 6A and 6B shows the wire after it has been formed. The chuck 602 continues to hold the deformed wire 601 for additional process steps. At this stage, the wire is longer than that shown in FIG. 2. The stamping process forms an included angle, A, into the wire and deforms the round cross-section of diameter, D, to a rectangular cross-section of thickness, t, and width, w. The mechanical dimensions, A, t, and w are optimized to meet the application requirements by customizing the upper and lower dies of FIG. 5. The application requirements across the entire array may be such that a single set of A, t, and w cannot satisfy the requirement. Hence, multiple sets of A, t, and w may be required and this is achieved by having multiple dies. It is preferable for high current carrying applications to use a large diameter wire, for example, 0.38 mm. The large diameter wire also eases the handling operations; however this typically requires larger stamping pressures to deform the wire to desired spring rates. The DC resistance for the bulk material of spring contact element is typically between 5 and 10 milliohms. After stamping, a typical thickness is 0.15 mm to 0.25 mm, typical width is 0.40 to 0.60 mm, and typical angle is 45 to 90 degrees. The final thickness, width, angle, and length to which the wire is deformed are degrees of freedom available for customizing the spring contact elements to the application.

A finite element model (FEM) was constructed to analyze the force deflection characteristics of the variable cross-section wire. FEM linear beam elements were used with each element indexed to its appropriate cross-sectional area property table. The node of the wire beam coincident with one electronic module was held fixed in both displacement and rotation. The node representing the wire beam contact was displaced by variable amounts and its rotation was left free. The curvature of the wire beam was modeled by using many linear beam elements in a faceted manner. The pertinent material properties for the BeCu bulk material include Young's modulus and Poisson's ratio, for example, 127.5 GPa and 0.29 respectively. The force characteristics are dependent on design parameters such as the included angle of the wire beam, moments of inertia, and material properties. From electrical contact theory, it is generally accepted that the minimum contact load for a reliable and repeatable contact is 30 grams for this size of contact. An example of results from the FEM analysis for a 90 degree included angle, 0.25 mm diameter wire, and a 60 percent stamping compression for the center portion of the wire beam reveals 0.1 mm as the minimum deflection to achieve the minimum loading. The maximum deflection is dependent on a tolerance analysis of the appropriate mounting hardware (i.e., board flatness, stiffener, substrate flatness, baseplate, etc.) and is application dependent. For a typical high performance application having a deflection of 0.30 mm, the maximum contact loading is 70 grams. For a 60 degree included angle, the maximum loading is reduced to about 60 grams.

FIG. 7A, FIG. 7B, and FIG. 7C show the installation of the overlong deformed wires into its retainer. A retainer half 702 is fixtured vertically and is prepared to receive overlong deformed wires by first aligning the centerline of its lower left hole to the centerline of the overlong deformed wire that is retained by the chuck 704 and 705. Each of the holes are chamfered on the inside of the retainer to lessen the centerline tolerance control and facilitate easier wire insertion. Prior to the installation of the wire into the retainer, the wire is rotated 90 degrees counterclockwise from its final position. The overlong wire 703 is in such position. After the wire is inserted completely into its retainer hole, it is rotated 90 degrees clockwise. Next, rest bar 707 is slid under the wire but not beyond the mid point to hole 708. A cutter 706 cuts the wire from the spool and causes the overlong deformed wire 701 to be completely restrained by the retainer 702 and the rest bar 707. At this point, the next deformed wire can be fabricated by having a finite length of wire fed through the chuck assembly and repeating the stamping process as detailed by FIG. 5.

The retainer 702 is indexed downward by one hole-to-hole spacing such the centerline of hole 709 is inline with the centerline of wire 703. As before (but now with the recently formed overlong wire), the wire is rotated counterclockwise as shown in FIG. 7A and 7B and is denoted by wire 703, is inserted into the receiving hole, the next rest bar 710 moves into place, the wire rotates clockwise (thereby placing its bent portion within the bent portion of wire 701), and the cutter 706 cuts the wire away from the spool. This procedure is repeated until the entire column of holes of the retainer, requiring a wire, is filled with overlong deformed wires. It is not a requirement for each hole to have a wire.

For those embodiments in which dissimilar formed spring contact elements are required, a machine having multiple stamping dies and feed through chucks is employed. If an overlong deformed wire to be installed is not the same as the previously installed wire, then the preceding chuck assembly is automated rotated away from the retainer and the correct chuck assembly having the correct deformed wire is rotated into place. Once brought into place, the installation process continues as previously described.

After an entire column is completed, a perforated separator 711 is inserted by step 410 into the grooves 712 located in the retainer 702 as shown in FIG. 7C. The perforations can be seen by viewing the sub-assembly at section B—B.

FIG. 7D shows this section B—B with only the perforated separator visible. The separator 711 is made from a dielectrical material and is used to prohibit the SCEs from contacting one another. The perforations are only used for high current carrying applications and are not typically required. The DC resistance of a typical SCE comprises of a bulk wire value and a contact resistance value for each contact. A typical total connector resistance range for contact loading between 30 and 70 grams is between 8 and 11 milliohms. A plausible high current carrying capacity embodiment could be 1 Amp per power contact. For an overall connector size of, say, 70 mm×70 mm with half the pins carrying high current, then a total power dissipation of 16.5 Watts could be due to resistive heating of the SCEs. For those embodiments needing the perforations, a coolant is pumped through the retainer housing and the resistive heating of the SCE's is dissipated to the coolant. The copper wire beams behave as pin fins with a uniform heat generation rate.

The next column of holes is filled by starting at position 713. One by one, the rest bars 710 travel horizontally across the connector housing, and eventually, the entire array is filled. At this time, the mating retainer to 702 is partially inserted by step 413 over the overlong SCE array so that each SCE is held within its respective hole in the mating retainer. Then, the entire set of rest bars 710 are removed by step 414 and are now available for the next connector assembly. Once the rest bars are removed, the mating retainer half is completely moved to contact 702, and mated by an adhesive such as epoxy or adhesive tape.

The spring contact element sizing process is shown in FIG. 8. A length gage 801 is used to center the overlong deformed wires 802 between the retainers 803. A cutter 804 travels across the array shown by the dotted line 805. The cutter can cut each SCE individually as it passes across the array,of multiple SCE can be cut at a time depending on cutter size and SCE spacing. Another gage and cutting step is used to size the other end of the wire. Before proceeding to the finishing step, the SCE ends are deburred and the sub-assembly is cleaned by conventional means.

FIG. 9 shows a fixture to house the connector assembly 902 for gold electroplating. The fixture conductor 901 makes electrical contact with each wire at their ends 903. The cover plate 904 locks the assembly against the fixture and assures good electrical contact. The ends 905 are now ready for plating. The ends are first plated with low stress Ni, using a conventual nickel sulfamate process. Next gold is plated over the nickel with a minimum thickness of typically 0.75 micrometers. Other plating material could be used, such as Pd—Ni, for lower cost applications; However, for high performance applications, gold is preferable, or alternatively, palladium dendrites can be formed by conventional processes. The same fixture is used as the plating process is repeated for the other ends of the wires. Alternatively, the ends can be prepared by conventional palladium dendrite process steps if so desired.

It should be understood that the above-described embodiments of this application are presented as examples and not as limitations. Modification may occur to those skilled in the art. Accordingly, the invention is not to be regarded as being limited by the embodiments disclosed herein, but as defined by the appended claims.

Having thus described our invention, what we claim as new and desire to secure by Letters patent is:

1. A method of providing a connector assembly having a plurality of spring contact elements in a retainer, said method comprising:

feeding a metallic spring wire through a chuck between a die to a measure stop; the chuck having a stop, a holding device, two opposing die and a wire cutter;

forming said metallic spring wire into a flat portion with a bend having an angle in a plane;

cutting said metallic spring wire after being formed by the forming step to provide a formed spring contact element with a length longer than a finished length of said formed spring contact element;

rotating said chuck containing the formed spring contact element to align the plane of the element with a column being arranged in the retainer;

guiding by the chuck of an end of the formed spring contact element through a hole in a first part of said retainer;

indexing a position of the first part of said retainer relative to said chuck to align with a next hole in the first part of the retainer;

installing a separator in slots in said first part of said retainer adjacent to edges of said formed spring contact element being placed in the column; and engaging a second part of said retainer with the first part while passing said spring contact element through opposite holes in a second part of the retainer.

2. The method according to claim 1 wherein said formed spring contact element (SCE) is made of beryllium copper.

3. The method according to claim 1 wherein said separator is made of a non-conducting material.

4. The method according to claim 1 wherein said metallic spring wire was plated prior to being placed in said chuck.

5. The method according to claim 4 wherein said SCE was plated with a conducting layer of nickel.

6. The method according to claim 5 wherein palladium is plated over said nickel.

7. The method according to claim 1 wherein said chuck is mounted on a rotating device with a multiplicity of other chucks.

8. The method according to claim 7 wherein said chucks handle different sizes of wire for forming SCEs with different spring characteristics.

9. The method according to claim 1 wherein said SCEs are cut and placed on a resting bar while being supported by the first part of the retainer.

10. The method according to claim 9 wherein said guiding step uses the resting bar which is indexed across said retainer to hold SCEs for each of plural columns of SCEs being inserted in the first part of the retainer.

11. The method according to claim 1 wherein a said separator is inserted in slots in said first retainer part before proceeding to insert SCEs for a next column.

12. The method according to claim 1 wherein said indexing step moves the first part of the retainer for an SCE relative to any other hole in same column.

13. The method according to claim 1 wherein said SCE is placed by the chuck in said first part of the retainer, one SCE at a time until the column is full of SCEs.

14. The method according to claim 1 wherein said parts of the retainer are bonded together at completion of inserting said SCEs and said separators for each column in the retainer.

15. The method according to claim 1 wherein said cutting step uses a gage and cutting blade positioned at an exact depth adjacent to the surface of at least one of said retainers for forming contact ends on the SCEs.

16. The method according to claim 15 wherein said contact ends of said SCEs are electroplated.

17. The method according to claim 16 wherein the contact ends of each SCE are electroplated with gold or dendrites.

18. The method according to claim 1 wherein said forming step further comprises:

moving a die for slideably supporting contact ends of an unformed spring wire while flattening and bending a central part of the spring wire to conform with the shape of the die.

19. The method according to claim 1 wherein said holes in the second part of said retainer are bevelled on an interior wall of said second part of the retainer.

* * * * *